United States Patent [19]

Maruyama

[11] Patent Number: 4,718,835

[45] Date of Patent: Jan. 12, 1988

[54] MINING APPARATUS AND JET PUMP THEREFOR

[75] Inventor: Manabu Maruyama, Yokohama, Japan

[73] Assignees: IDC Kabushiki Kaisha; Kabushiki Kaisha Miwa Susakusko, both of Yokohama, Japan

[21] Appl. No.: 831,591

[22] Filed: Feb. 21, 1986

[30] Foreign Application Priority Data

Feb. 23, 1985 [JP] Japan ..... 60-35117

[51] Int. Cl.[4] ..... F04F 5/42; F04F 5/46

[52] U.S. Cl. ..... 417/171; 37/DIG. 1; 37/DIG. 8; 137/874; 417/174; 417/179; 417/189; 417/197

[58] Field of Search ..... 417/76, 87, 151, 155, 417/160, 171, 174, 179, 187, 188, 189, 197, 63; 37/DIG. 1, DIG. 8; 406/34; 137/873, 874, 875, 625.44

[56] References Cited

U.S. PATENT DOCUMENTS

| | | | |
|---|---|---|---|
| 1,275,166 | 8/1918 | Krippene | 137/874 |
| 2,803,963 | 8/1957 | Condolios | 73/438 |
| 2,960,040 | 11/1960 | Bischoff | 417/63 |
| 3,318,327 | 9/1967 | Himes et al. | 37/DIG. 8 |
| 3,413,038 | 11/1968 | Frazier | 406/14 |
| 3,448,691 | 6/1969 | Frazier | 417/189 |
| 3,486,570 | 12/1969 | Richardson | 175/5 |
| 3,672,725 | 6/1972 | Johnson | 37/DIG. 8 |
| 3,765,727 | 10/1973 | Santangelo et al. | 406/153 |
| 4,400,138 | 8/1983 | Baer | 417/179 |
| 4,487,553 | 12/1984 | Nagata | 417/171 |

FOREIGN PATENT DOCUMENTS 1096406 6/1984 U.S.S.R. .

*Primary Examiner*—Leonard E. Smith

*Attorney, Agent, or Firm*—Marshall, O'Toole, Gerstein, Murray & Bicknell

[57] ABSTRACT

This disclosure relates to deep sea mining apparatus, comprising a relatively straight lift pipe, the lift pipe being adapted to extend substantially vertically from the floor of a body of water upwardly to a ship on the surface of the water. A plurality of jet pumps are connected in the pipe at intermittent locations along the length of said pipe, and a hydraulic feed pump is located adjacent each of the jet pumps and is connected to discharge water in its location and to supply the associated jet pump. Means is also provided for injecting compressed air into the jet pumps, the jet pumps thereby forming an ascending current inside the lift pipe by the introduction of the compressed air and water. A densimeter and a flow meter are connected in the pipe, and control means is connected to respond to the outputs of the densimeter and the flow meter and to control the supply of pressurized water from the hydraulic feed pumps to the jet pumps and the amount of compressed air introduced to the lift pipe, in response to the outputs of the densimeter and the flow meter.

2 Claims, 19 Drawing Figures

COMPARATOR
19
20
FUNCTION GENERATOR
22
CONTROL CIRCUIT
21
9a
10a
PII
10c
PIIa
FUNCTION GENERATOR
24
23
CONTROL CIRCUIT
25
26
9c
10b
PIj
Pija 5
9d
PII
PIIa
PROGRAMED FLOW SETTING CIRCUIT
31
28
30
CONTROL CIRCUIT
27
9e
PIj
Pija 5
9f
PII
PIIa
CONTROL CIRCUIT
32

TO PROCESSOR 11
TO MONITOR 15
ΔP

PIPE J1
P11
P11a

MINING APPARATUS AND JET PUMP THEREFOR

FIELD AND BACKGROUND OF THE INVENTION

This invention relates to deep water mining apparatus and to a jet pump for use with such apparatus, for collecting and recovering metal ore, etc., from, for example, the ocean floor.

Pieces of manganese and other metal ores ranging in size from 0.5 to 25 cm in diameter lay scattered across the ocean floor at depths of up to 5,000 to 6,000 meters. A mining apparatus for collecting these pieces and bringing them up to the surface should be as uncomplicated as possible and at the same time be capable of providing efficient mining performance. In addition, concerning a jet pump in the form described in U.S. Pat. No. 4,487,553, the design of such a pump calls for the main body of the pump to be formed in the shape of a conical shell, with pressurized water being jetted from a large number of nozzles arranged around the circumference of the large-diameter end (base) of this shell. High-pressure air is sprayed in the vicinity of these nozzles in order to enclose the pressurized water jets with air and thus prevent the occurrence of vortex kinetic energy.

However, although this jet pump design works well when the pressure of the water jets from the nozzles is relatively low and the flow volume is large, problems occur when high-pressure jets are used in order to improve the overall performance of the pump. Experiments show that the cause of these problems is that the cross-sectional area (or diameter) of the jets is inversely proportional to the flow speed of the jets and decreases as the speed of the jets increases, thus causing gaps to appear between adjacent water jets. These gaps are not filled by the air being introduced, and consequently a current flow in the opposite direction of the jets is created in these gaps. As a result of this reverse current, the jets and the layers of air enclosing them are disturbed, thus causing a reduction in performance efficiency.

It is a general object of this invention to provide mining apparatus which is uncomplicated in design and which provides for efficient recovery of metal ore and other minerals, and which also uses an improved jet pump.

BRIEF SUMMARY OF THE INVENTION

Mining apparatus in accordance with the invention comprises a collector designed to operate on the floor or bed of a body of water and to gather pieces of ore and minerals. A substantially straight lift pipe extends from the collector vertically to the water surface, and the pipe receives the pieces from the collector. A plurality of jet pumps are consecutively and intermittently disposed in the lift pipe, and hydraulic feed pumps are located adjacent to the jet pumps and discharge water in order to supply the jet pumps. The jet pumps also receive compressed air, and they form an ascending current inside the lift pipe by action of the compressed air. A densimeter and/or a pressure gauge and a flow meter are arranged in the feed pipe, so that the mining apparatus controls the supply of pressurized water from the hydraulic feed pumps to the jet pumps and the amount of compressed air introduced into the lift pipe in response to the outputs of the densimeter and/or pressure gauge and the flow meter.

Another aspect of this invention is that television cameras are located along the route of the lift pipe in order to televise internal views of the lift pipe.

Another aspect of this invention is that television cameras are located at the lower end of the lift pipe.

Another aspect of this invention is that the lift pipe can be opened by separating parts of the lift pipe and moving sections of the pipe at right angles to the axis of the lift pipe.

Another aspect of this invention is that a higher pressure for the compressed air is supplied to the jet pumps as the depth increases.

Another aspect of this invention is that the jet pumps are divided into groups and the pressure of the compressed air supplied to each of these groups increases as the depth increases, and the pressure of the compressed air supplied to the jet pumps in each of these groups is increased by a distributor as the depth increases.

Another aspect of this invention is that the main body of the jet pumps has a linear-shaped passage which is coaxial with the lift pipe. This main body is surrounded by multiple spray passages which slant in toward the axis of the lift pipe as they extend toward the top of the jet pump, and which are connected to the linear-shaped passage. These spray passages consist of a first passage at the center for the supply of the pressurized water from the pump and a second passage around the circumference for the supply of the compressed air.

Another aspect of this invention is that each spray passage is equipped with a first nozzle forming a nozzle port for the supply of the pressurized water, and a second nozzle which surrounds the first nozzle, thus forming the second passage between the external circumference of the first nozzle and the inner surfaces of the second nozzle.

Another aspect of this invention is that the jet pumps are equipped with a casing which contains a common pressure chamber connected to all of the nozzle ports of the first nozzle, and which is capable of being dismounted from and remounted to the main body of the jet pump.

Furthermore, a jet pump according to this invention is comprised of a main body having a linear passage through its center and of multiple independent spray passages which are arranged around the main body of the jet pump and which slant inwardly toward and connect at the top with the linear passage. Each of the spray passages is provided at the center of its base with a first nozzle for the spraying of pressurized water, and the outside of the first nozzle is surrounded by a second nozzle provided for the spraying of compressed air. In addition, the jet pump features a casing capable of being dismounted from and remounted to the main body of the jet pump containing a common pressure chamber connected to all nozzle ports of the first nozzle.

In the operation of the mining apparatus, the pressure of the water supplied to each jet pump by a hydraulic feed pump is equal to the pressure due to the action of the hydraulic feed pump plus the water head at the depth of the hydraulic feed pump, thereby making it possible to supply the water to the jet pumps at a high pressure using compact hydraulic feed pumps. The jet pumps are also supplied with compressed air, thus forming a considerable ascending current inside the lift pipe. This ascending current makes it possible to suck up pieces of metal ore and other minerals from the lower end of the lift pipe and lift them to the water surface. The densimeter and the flow meter control to a high degree of precision the flow of compressed air and pressurized water, thus making possible the highly efficient retrieval of metal ore, etc.

In order to eliminate the reverse current (excessive space) which occurs in the conventional jet pump previously described, the jet pump used in this invention is designed so that the spray passages which join the main pipe correspond to the cross-sectional area (diameter) of the jets, thus preventing the cross-sectional area of the main pipe from being larger than the cross-sectional area of the jets and the layers of air which surround them until the jets completely join the main pipe. In other words, using the jet pump according to this invention, because the spray passages which connect with the main pipe are each separate and independent and the jet flow in the center of each spray passage is sprayed into the main pipe enclosed within an air current which surrounds it, the kinetic energy of the jets is transmitted a considerable distance without loss. Thus, the higher the pressure (the faster the flow speed) of the driving jets, the more effective the jets become. In this way, it becomes possible to greatly increase overall pump efficiency for a high-pressure (low water volume) type pump. In addition, because there are no gaps between the jets even when the jet pressure is high, there is no reverse current generated.

BRIEF DESCRIPTION OF THE DRAWINGS

This invention will be better understood from the following detailed description taken in conjunction with the accompanying figures of the drawings, wherein.

DETAILED DESCRIPTION OF THE DRAWINGS

Figure 1:
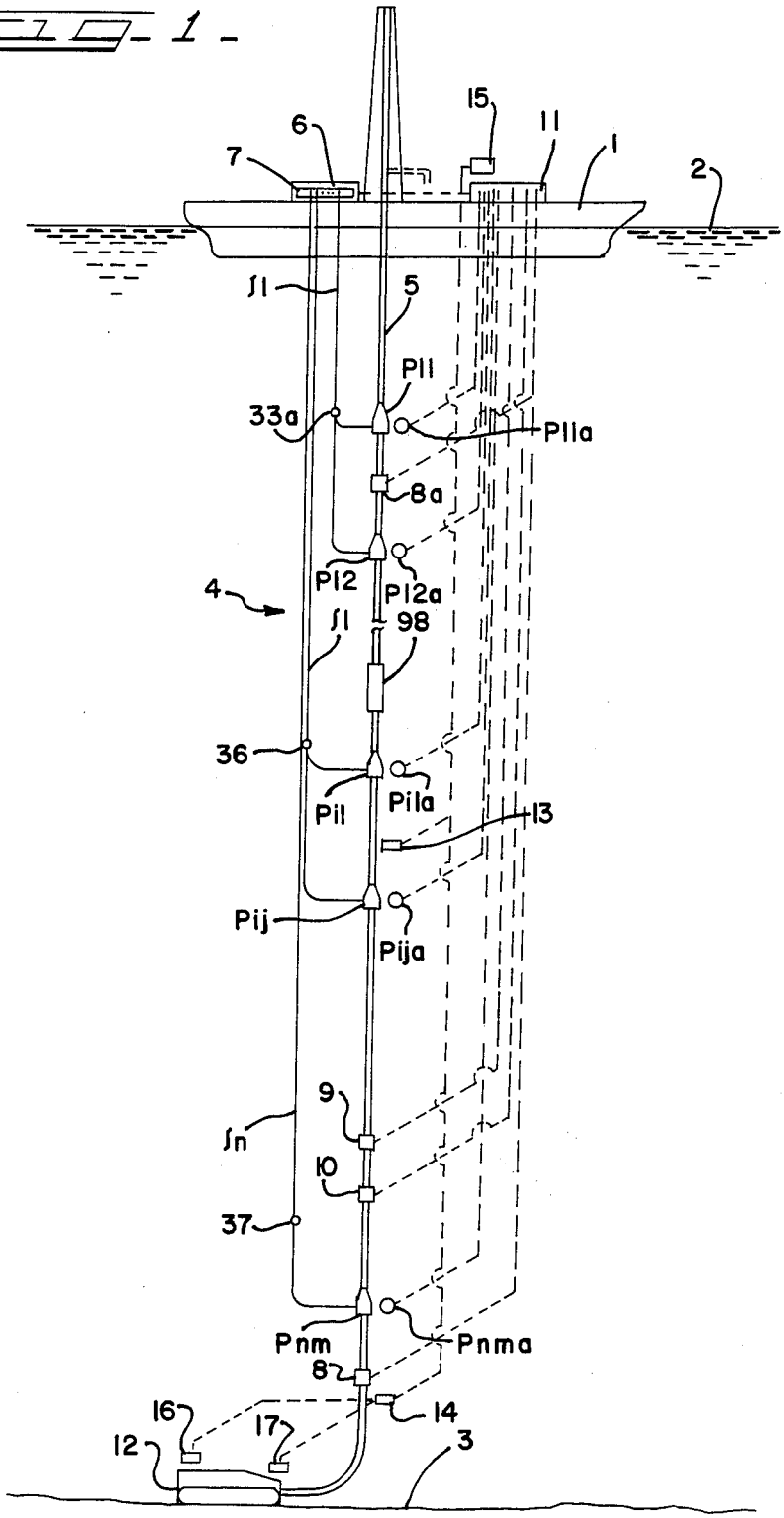
FIG. 1 is a diagram of an overall system according to a preferred embodiment of this invention.
Figure 1A:
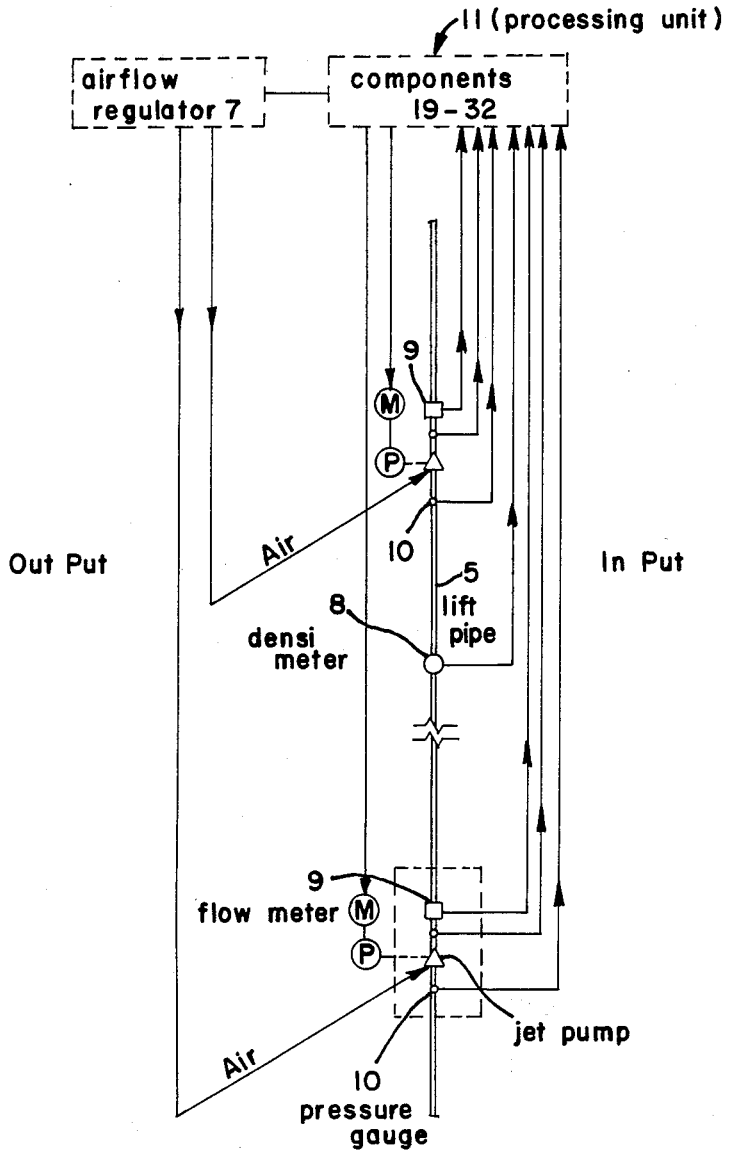
FIG. 1A is a further diagram showing the system.

FIG. 1 is a diagram showing an embodiment of this invention. A mining ship 1 is floating on the surface 2 of a body of water such as an ocean or sea, and pieces of manganese and other metal ore are scattered about on the sea floor 3. This metal ore is raised to the mining ship 1 by the mining apparatus 4 according to this invention. The depth of the sea floor 3 may be as much as 5,000 to 6,000 meters. A straight lift pipe 5 extends vertically and has a plurality of jet pumps P11, P12, Pil, Pij, Pnm of identical design spaced consecutively along it. The jet pumps should be located approximately every 50 to 100 meters. Hydraulic feed pumps P11*a*, P12*a*, Pila, Pija, Pnma are associated with the jet pumps P11 through Pnm, and are located in the respective vicinities of the jet pumps. These hydraulic feed pumps P11*a* through Pnma discharge water at their respective locations and supply the water to the corresponding jet pumps P11 through Pnm. Compressed air is also supplied to the jet pumps P11through Pnm from a compressor 6 on the ship 1 via separate airflow regulators 7 and flexible pipes l1 through ln. The pressurized water from the hydraulic feed pumps P11*a* through Pnma and the compressed air from the flexible pipes l1 through ln cause an ascending current to form within the jet pumps P11 through Pnm, and thus within the lift pipe 5. This ascending current makes it possible to suck up the pieces of metal ore from the sea floor 3 and raise them to the surface.

The lift pipe 5 is equipped with a densimeter 8 which measures the density of the objects including the pieces of ore passing through the lift pipe 5, a flow meter 9 which measures the flow volume of the objects including the pieces in the lift pipe 5, and a pressure gauge 10 which measures the pressure inside the lift pipe 5. The outputs of the densimeter 8, the flow meter 9, and the pressure gauge 10 are fed to and interpreted by a computer on the ship 1.

A collector 12 which collects the pieces of metal ore from the sea floor 3 is connected to the lower end of the lift pipe 5 and is connected to a processing unit 11. This collector 12 may be self-propelled by caterpillar treads or by other means, and as it moves on the floor 3 it gathers up the metal ore pieces and guides them to the lower end or intake of the lift pipe 5.

Parts of the lift pipe 5 are made of a transparent material, and television cameras 13 and 14 televise conditions inside the lift pipe 5 through these transparent parts; the cameras are connected by transmission lines to a display monitor 15 on the ship so that the conditions can be observed on the display 15. The collector 12 is also equipped with television cameras 16 and 17 so that the collection of the metal ore by the collector 12 may be observed on the display 15 aboard the mining ship 1. By means of the television cameras 13 and 14 provided on the lift pipe 5, it is possible to observe the conditions of the metal ore inside the lift pipe 5 when the mining operation is stopped. For example, in the event of an emergency or any other stop operation, it may be necessary to expel any metal ore that remains inside the lift pipe 5, and for this reason the television cameras 13 and 14 are useful.

The processing unit 11 is a micro processor which controls the mining apparatus 4 according to this invention, in accordance with a predetermined program. For example, at the start of operation, the processing unit 11 starts the jet pumps P11 through Pnm in operation in order from the uppermost to the lowermost pump. Also, during continuous operation, the unit 11 controls the jet pumps P11 through Pnm so that they operate efficiently. In addition, during a stopping operation, the processing unit 11 shuts off the jet pumps P11 through Pnm in order from the bottommost to the uppermost, thus making it possible to raise all of the metal ore in the lift pipe 5 into the mining ship 1. In the event of an emergency, the processing unit 11 makes it possible to take appropriate action and to stop the operation safely. In addition, the design of the processing unit 11 also allows adjustments to be made during continuous operation and emergency actions to be carried out manually.

Figures 2, 3, 4:
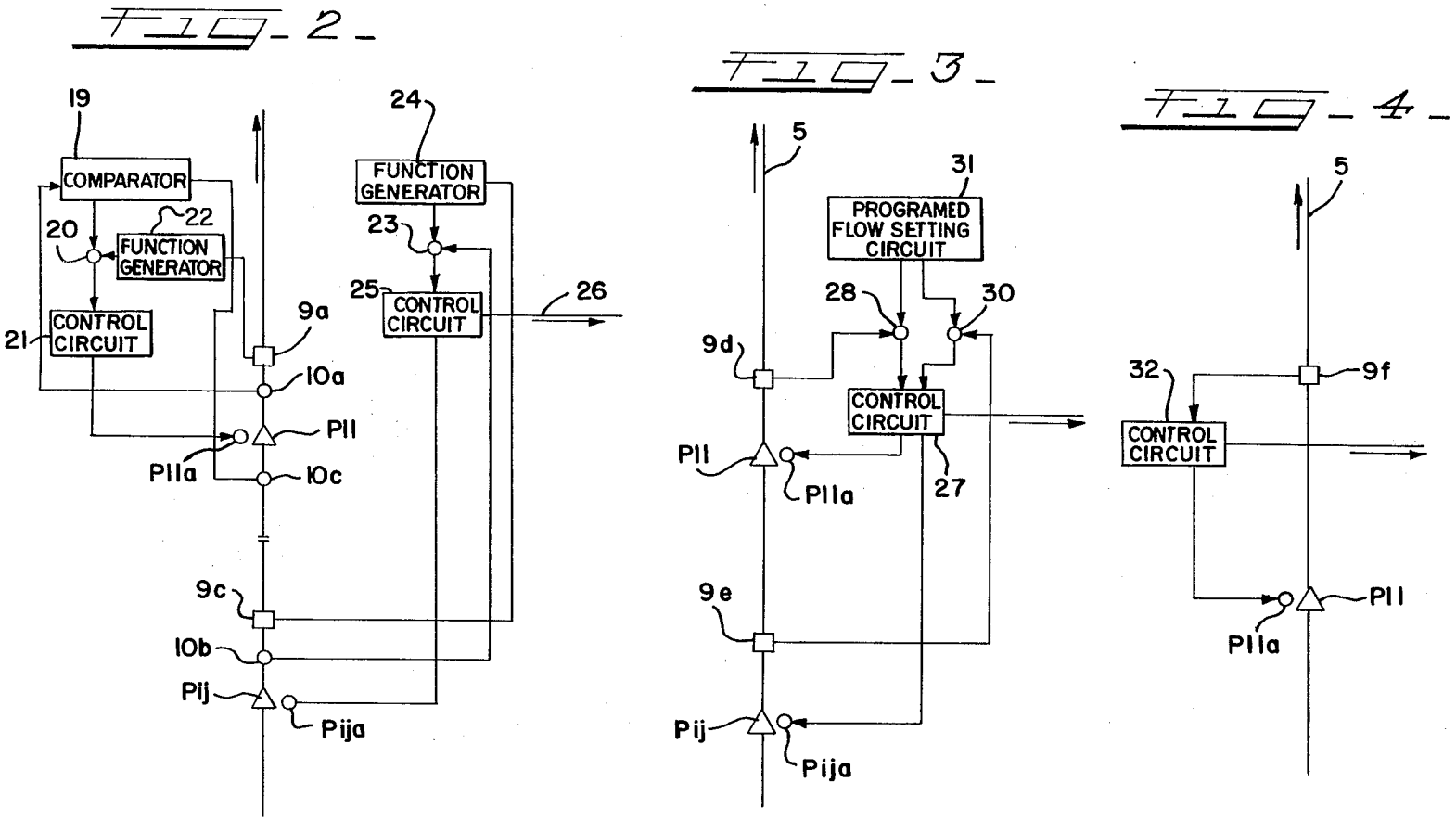
FIG. 2 is a block diagram showing a terminal-pressure fixed-level control system and its composition for operation of the jet pumps of the system.
FIG. 3 is a block diagram showing a flow-volume program control system according to another embodiment of this invention.
FIG. 4 is a block diagram showing a direct control system according to another embodiment of this invention.

FIG. 2 is a block diagram showing an arrangement for terminal-pressure fixed-level control, and shows the composition of the processing unit 11 with respect to the jet pumps P11 to Pij. The jet pump P11 is associated with a flow meter 9*a*, a pressure gauge 10*c*, and also with another pressure gauge 10*a*. The outputs from the pressure gauges 10*a* and 10*c* are fed to a comparator 19, and the resultant output is sent to a speed regulating circuit 21 via an adder-subtracter circuit 20. The circuit 21 is connected to control the output of the hydraulic feed pump P11a. The output from the flow meter 9*a* is sent to a flow-head (volume) function generator 22. The signal output from the circuit 22 is sent to the adder-subtracter circuit 20.

The other jet pump Pij is provided with a flow meter 9*c* and a pressure gauge 10*b*. The output from the pressure gauge 10*b* is sent to an adder-subtracter 23. Also, the output from the flow meter 9*c* is sent to a function generator 24 similar to the circuit 22, and the output from this function generator 24 is sent to the adder-subtracter 23. The output from the adder-subtracter 23 is sent to a speed regulating circuit 25, which controls the hydraulic feed pump Pija. The output from the speed regulating circuit 25 is also fed via line 26 to the airflow volume regulator (FIG. 1). Thus the hydraulic feed pump Pija functions to maintain the pressure at a certain calculated point in the pipe at a constant level, and the other hydraulic feed pump P11a functions to distribute the water head for both pumps. In this way it is possible to regulate the water head distribution of the jet pumps P11 to Pij for each section while maintaining the pressure within the lift pipe 5 with respect to a certain calculated point, at each fixed depth interval, at a predetermined level.

FIG. 3 shows a flow volume programed control system according to another embodiment of this invention. The hydraulic feed pump P11a for jet pump P11 is regulated by the output of a speed regulating control circuit 27. The output from flow meter 9*d* is sent to an adder-subtracter 28. The output of the speed regulating circuit 27 is also sent to the hydraulic feed pump Pija for jet pump Pij. The output of flow meter 9*c* is sent to adder-subtracter circuit 30. Adder-subtracter circuits 20 and 30 receive the output from a programed flow setting circuit 31 in the computer. In this way it is possible to maintain the flow within the lift pipe with respect to a certain calculated point, at a level designated by a predetermined program in the computer.

FIG. 4 shows a direct control system according to another embodiment of this invention. The hydraulic feed pump P11a for jet pump P11 is regulated by a speed regulating control circuit 32. The output from a flow meter 9*f* is sent to the regulating circuit 32. Control is carried out in accordance with the difference between a target value set in the control circuit 32 and the value measured by flow meter 9*f* in the lift pipe 5. In this case it is necessary for the target value to take into consideration the deviation of the flow meter 9*f* and the time delay of jet pump P11.

The terminal pressure fixed-level control system shown in FIG. 2, the flow volume program control system shown in FIG. 3, and the direct control system shown in FIG. 4 can be used independently or in combination. Flow meters 9*a* through 9*f* and pressure gauges 10*a* and 10*b* are used in the embodiments shown in FIGS. 2 through 4, but these components have been omitted from FIG. 1 in order to simplify the diagram.

Another feature of this invention is to regulate the flow amounts of the pressurized water and compressed air at each of the jet pumps P11 through Pnm while using a densimeter 8 to measure the mineral content, thus improving the mining efficiency. In addition, with television cameras 13, 14, 16, and 17, the lifting conditions in the lift pipe 5 and the collecting conditions at the collector 12 can be viewed on a monitor screen 15 on the ship 1.

Figures 5, 6, 7, 8, 9, 10:
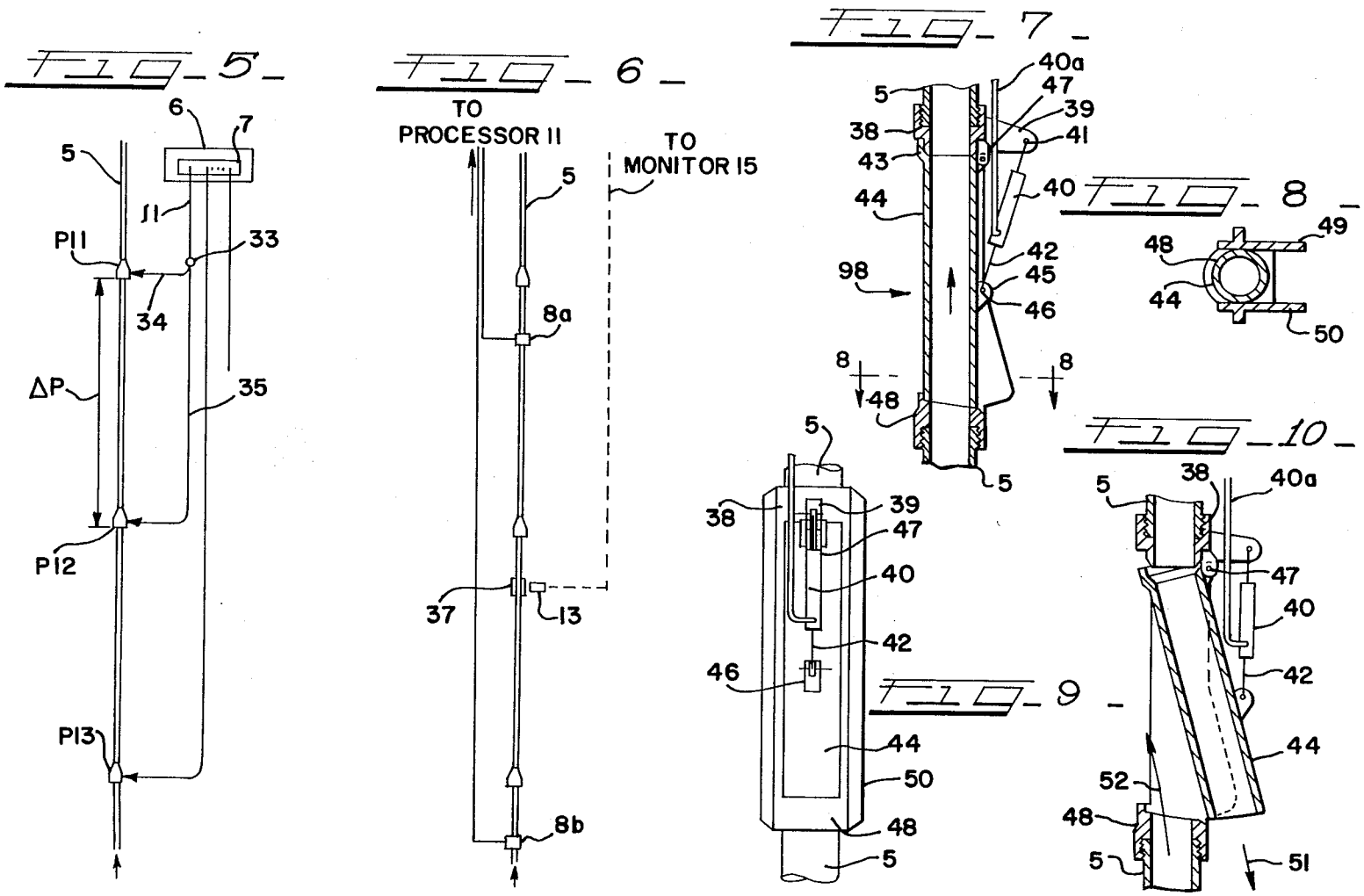
FIG. 5 is a system diagram showing the hydraulic feed pump which supplies a jet pump P11.
FIG. 6 is a diagram showing the arrangement of a television camera 13.
FIG. 7 is a cross-sectional view showing a damper located partway along the length of the lift pipe.
FIG. 8 is the cross-sectional view taken on the line VIII—VIII in FIG. 7.
FIG. 9 is a right-side view of the damper shown in FIG. 7.
FIG. 10 is a cross-sectional view of the damper when in open position.

FIG. 5 shows the route of the air pressure to the jet pumps P11 and P12 via pipe l1. Pipe l1 is provided with a pressure distributor 33. This distributor 33 supplies compressed air at pressure P1 to the upper jet pump P11 via pipe 34, and it also supplies compressed air at pressure P2 to jet pump P12 via pipe 35. Distributor 33 operates such that, if the difference in the pressure of the sea water between the two jet pumps P11 and P12 is $\Delta P$, the pressures P1 and P2 of the compressed air will have the relationship defined by equation 1:

$$P2 = P1 + \Delta P \quad (1)$$

In this way, the pressure of the compressed air supplied to the lower jet pump P12 is $\Delta P$ higher than that of the compressed air supplied to the upper jet pump P11, thus making possible the efficient formation of an ascending current inside the lift pipe 5. Thus jet pumps P11 and P12 comprise the 1st group, jet pumps Pi1, Pij comprise the i'th group, and jet pump Pnm comprises the n'th group. In this way, the compressed air is supplied to each of the various groups via corresponding pipes l1, li and ln (FIG. 1), and the pressure of the compressed air supplied to each jet pump P11 through Pnm is regulated by distributors 33, 36, 37 as described in connection with Equation (1) located on corresponding pipes l1, li, and ln, thus making efficient mining possible.

FIG. 6 shows the arrangement of the television camera 13 located on the lift pipe 5. Densimeters 8*a*, 8*b* are located on lift pipe 5 at appropriate intervals, and their outputs are sent to the processing unit 11. Tube 37 is constructed of transparent material and forms the part of the lift pipe 5 at which television camera 13 is installed, in order to allow the inside of lift pipe 5 to be observed. The video signal of the inside of lift pipe 5 is picked up by television camera 13 through tube 37, and is sent to the monitor 15.

Referring to FIGS. 2, 3 and 4, the controls 21, 25, 27 and 32 represent motor speed control circuits for controlling the pressure (flow rate) of hydraulic water to each jet pump.

In FIG. 2, the numeral 22 indicates a flow-head function generator adapted to artificially set a target value of head (difference between the suction pressure and delivery pressure of the pump) relative to the flow rate for each of jet pumps P11. Thus, the pressures at 10c and 10a are measured and the difference is fed back so as to control the pump head to the target value. The device 24 sets a target value for pressure at an optional point (for example, the terminal end of each group) of the lift pipe 5, feeds back the measured flow rate value 9c, computes the delivery pressure value 10b of jet pump pij (Pija) and effects control to realize the target pressure.

Referring to FIG. 3, the change in flow rate at an optional point of the lift pipe 5 is controlled by feeding back the measured value of flow rate on the delivery side of each jet pump and computing the difference in accordance with a given preset target value program so as to realized the programmed target value.

Referring to FIG. 4, which illustrates a direct control system, the flow rate 9f at the terminal location, for instance, instead of an optional calculated point, is directly measured and control is made according to its deviation from a preset target value. Therefore, due to the distance between the point of measurement and the point of control, there is a delay in control time.

Referring to FIG. 6, the densimeter 8 measures the mineral contents and air volumes at various optional points and transmit the values to a processing unit 11. Based on these measured values, the processing unit 11 corrects the programmed target values for the above-mentioned control systems (FIGS. 2, 3 and 4). Correction is also made for the output to the air flow regulator 7, so that a combination of jet pump hydraulic pressure and air volume necessary for realizing an ideal flow at any given point can be obtained.

Thus, as the data generated by the pressure gauges, flow meters, and densimeters are processed in the processing unit 11, not only multiple controls can be realized but because the operating condition of each jet pump and the transporting condition at each point within the lift pipe can be monitored, control taking into account the efficiency of the whole equipment can be made feasible.

FIG. 7 shows a part of a damper 98 (see also FIG. 1) which is built into the lift pipe 5. A mounting collar 38 is attached to the lift pipe 5 and a bracket 39 is secured to this mounting collar 38. The head end of a single-action hydraulic cylinder 40 is secured to the bracket 39 by a pin 41. The piston rod 42 of the cylinder 40 is coupled by a pin 46 to the bracket 45 of a swinging tube 44 whose top end 43 fits into the mounting collar 38. This swinging tube 44 is coupled by a pin 47 to the mounting collar 38. The lower end of this swinging tube 44 connects with mounting collars 48 which are attached to a lower section of the lift pipe 5.

FIG. 8 is a cross-sectional view seen from plane VIII—VIII in FIG. 7, and FIG. 9 is the front view. Guide plates 49 and 50 which guide the swinging tube 44 extend vertically between the mounting collars 38 and 48. The piston rod 42 is retracted when hydraulic fluid is supplied to the cylinder 40 through a line 40a that extends to the ship 1, and the swinging tube 44 pivots counterclockwise around pin 47 as shown in FIG. 10. In this way, any pieces of ore remaining in the lift pipe 5 above the swinging tube 44 when operation is stopped can be discharged in the direction of arrow 51. In addition, any pieces of ore moving up the lift pipe 5 from below the swinging tube 44 can be discharged in the direction of arrow 52. Thus pieces of ore remaining in the lift pipe 5 can be removed from the lift pipe 5 while operation is stopped or just prior to stopping operation. The lower end of the swinging tube 44 separates completely from the mounting collar 48 as shown in FIG. 10; thus any pieces of ore moving downwardly through the swinging tube 44 would be discharged in the direction of arrow 51 as just mentioned, and there would be no chance of such pieces reentering the mounting tube 48. Pin 47, which is the axis upon which the swinging tube 44 swings outwardly, extends at right angles to the linear axis of the lift pipe 5. When the hydraulic pressure in the cylinder 40 is released, the weight of the tube 44 swings it down to the closed position shown in FIG. 7; a return spring may be provided in the cylinder 40 to assist movement to the closed position.

Figures 11, 12, 13:
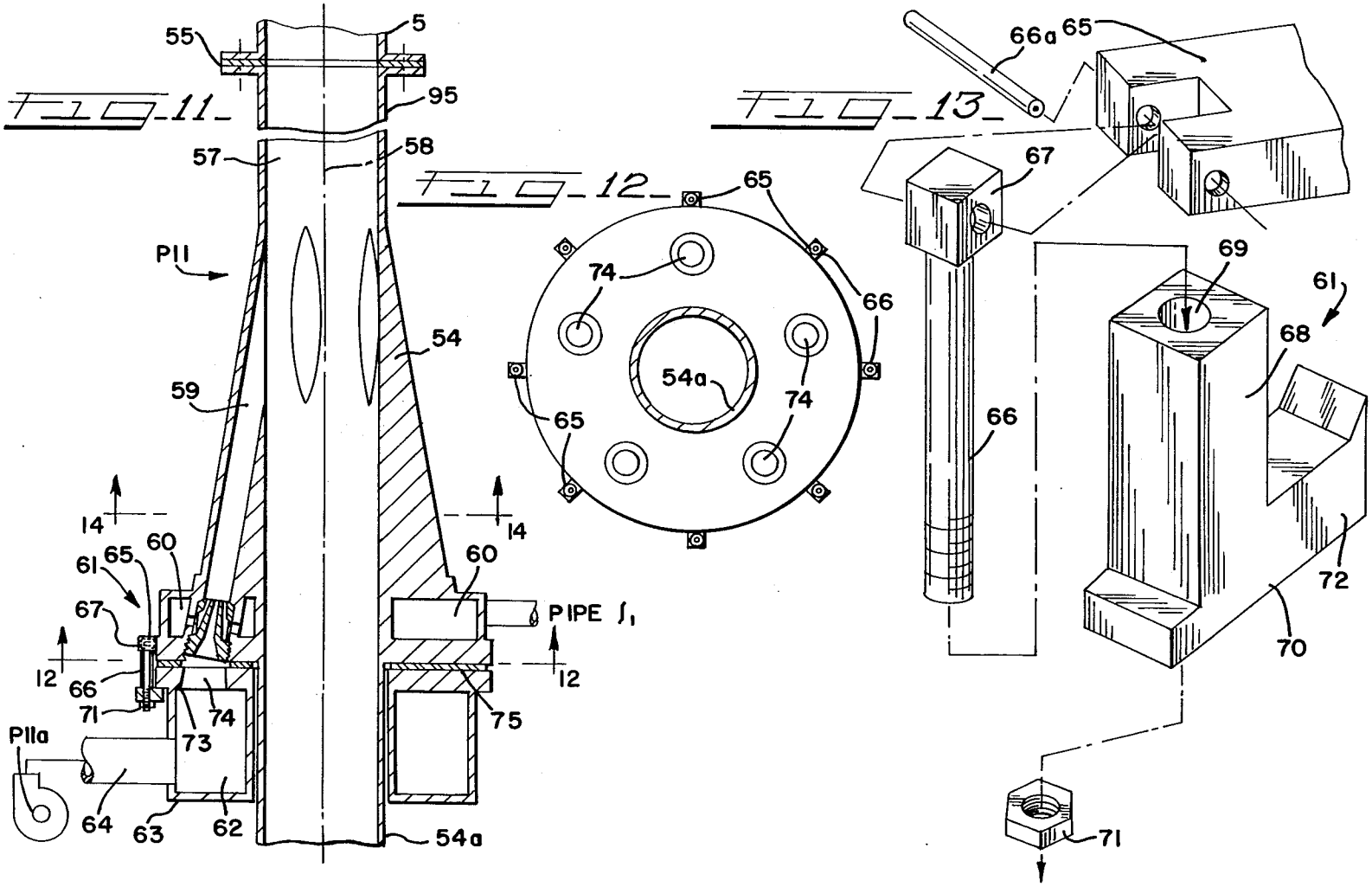
FIG. 11 is a cross-sectional view of a jet pump.
FIG. 12 is a cross-sectional view taken on the line XII—XII in FIG. 11.
FIG. 13 is an exploded perspective view of a mounting means of the pump.

FIG. 11 is a cross-sectional view of the jet pump P11, which is representative of the other jet pumps. The main body 54 of the jet pump is coupled to a section of the lift pipe 5 by flange joints 55, and this main body 54 forms a central linear passage 57 which is coaxial with the lift pipe 5. The main body 54 of the jet pump is equipped with a plurality of circumferentially spaced water spray passages 59 which slant inwardly toward the pipe axis 58 as they extend upwardly.

Figure 14:
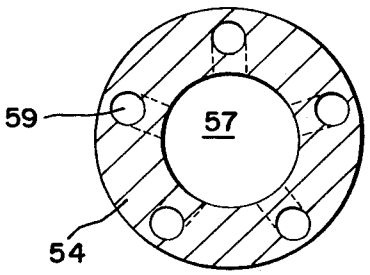
FIG. 14 is the cross-sectional view taken on the line XIV—XIV in FIG. 11.

Five (in this embodiment) spray passages 59 are arranged around the circumference of the main body 54 of the jet pump as shown in FIG. 14, and the axes of these spray passages 59 lie on planes which intersect the pipe axis 58. An annular air chamber 60 is located at the lower end of the main body 54 of the jet pump. This air chamber 60 is supplied with compressed air via pipe 11, distributor 33, and pipe 34. A circular manifold or casing 63, which forms an annular pressurized water chamber 62, is detachably mounted to the lower end of the main body 54 of the jet pump by mounting means 61. This circular casing 63 surrounds the lower end 54a of the main body 54 of the jet pump. The pressurized water chamber 62 is supplied with pressurized water by the hydraulic feed pump P11a via pipe 64. As shown in FIG. 13, the mounting means 61 includes a bracket 65 mounted to the main body 54 of the jet pump, a hinge pin 66a which is attached to this bracket 65, and the head 67 of a bolt 66 which is suspended from this hinge pin 66a. The bolt 66 is inserted loosely in a through-hole 69 in a hook piece 68 and secured beneath the bottom surface 70 of the hook piece 68 by a nut 71. The hook 72 part of the hook piece 68 fits into an indentation 73 formed in the circular casing 63. By tightening the nut 71, the hook 72 can be held securely in the indentation 73.

Connecting ports 74 which connect to the pressurized water chamber 62 are formed in the upper side of the circular casing 63. A gasket 75 is inserted between the main body 54 of the jet pump and the circular casing 63.

Figure 15:
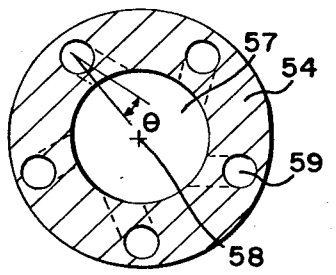
FIG. 15 is a cross-sectional view similar to FIG. 14 but showing another embodiment of this invention.

FIG. 15 is a cross-sectional view similar to FIG. 14 and showing an alternative arrangement of the spray passages. The same reference numbers are used to identify corresponding parts. The spray passages 59 (FIG. 15) formed in the main body 54 of the jet pump are offset or angled clockwise at an angle 0 with respect to the plane passing through the axis 58 of the main body 54 of the jet pump, i.e. with respect to a radial plane. By doing this, it causes the jet sprays from the spray passages 59 to spiral inside the linear passage 57.

Figure 17:
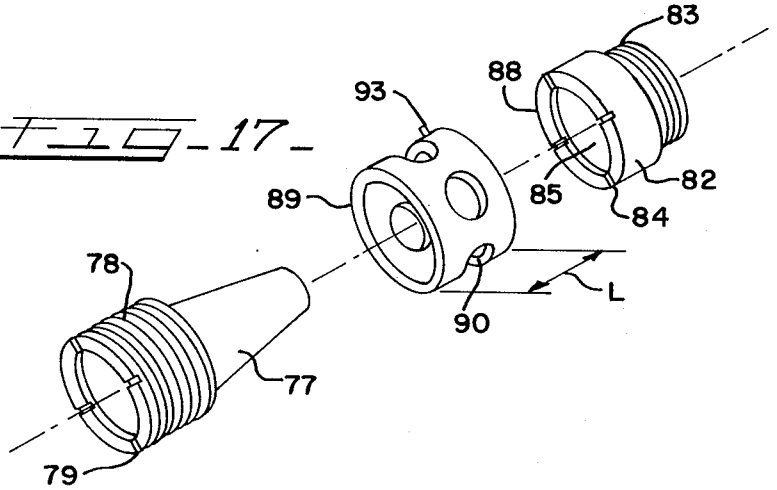
FIG. 17 is an exploded perspective view of parts shown in FIG. 16.
Figure 16:
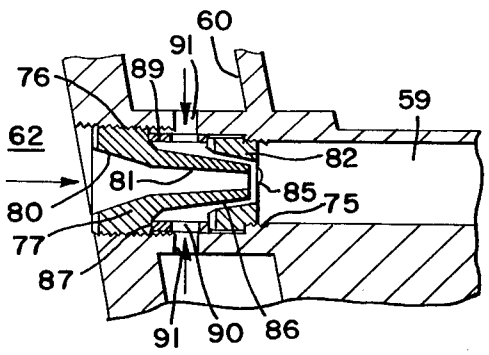
FIG. 16 is a cross-sectional view of a part of a jet pump.

FIG. 16 is a cross-sectional view of part of the jet pump P11, and FIG. 17 is an exploded perspective view of part of the structure in FIG. 16. The head or upstream end of each spray passage 59 is formed into an internal screw thread 75, and behind the thread 75 (to the left in FIG. 16 and to the bottom in FIG. 11) is formed into another internal screw thread 76 having a larger diameter. The external threads 78 of a first nozzle 77 is threaded into threads 76. Grooves 79 (FIG. 17) capable of accepting a screwdriver-like tool are formed in the end of the first nozzle 77 to allow the first nozzle 77 to be tightly installed by turning it on its axis. The pressurized water from the pressurized water chamber 62 is guided from a conical-shaped entrance port 80 in the first nozzle 77 to another conical-shaped port 81 having a smaller diameter, thus forming a first passage for the pressurized water.

The external threads 83 (FIG. 17) of a second nozzle 82 is threaded into the threads 75. Grooves 84 capable of accepting a screwdriver-like tool are also formed in the end of the second nozzle 82 so that the nozzle 82 can be tightly screwed in place. The second nozzle 82 has a conical-shaped nozzle port 85 with an inner diameter which is larger than the outer diameter of the first nozzle 77, and the first nozzle extends into the port 85. In this way, a second annular passage 86 for the supply of compressed air is formed between the outer surface of the first nozzle 77 and the inner surface of the second nozzle 82.

Figure 18:
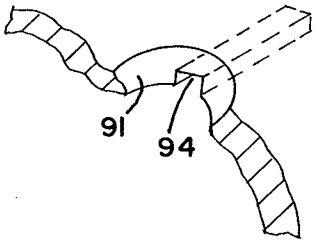
FIG. 18 is a fragmentary perspective view showing compressed air supply holes 91.

A cylindrical spacer 89 is inserted between the circular end 87 of the first nozzle 77 (which faces upstream) and the downstream end 88 of the second nozzle 82. There are multiple air passage holes 90 around the circumference of this spacer 89, and there are air supply holes 91 formed through the wall of the air chamber 60 of the main body 54 of the jet pump which overlie or communicate with the air passage holes 90. A pin projection 93 (FIG. 17) is formed on the outside of the spacer 89 and is located in a hole in the wall of the air chamber, in order to ensure that the air supply holes 91 and the air passage holes 90 are aligned correctly. As shown in FIG. 18, this alignment projection 93 projects toward the air supply holes 91 and can be fit into the alignment hole 94 which extends along the axis of the spray passage 59. Thus the compressed air from the air chamber 60 passes through the air supply holes 91 and the air passage holes 90 in the spacer 89, to be sprayed from the second passage 86. Selecting the appropriate lengthy L for the spacer 89 determines the appropriate cross-sectional area of the second passage 86. In this way, it is possible to achieve accurate regulation of the spray. By removing the mounting means 61, the circular casing 63 can be moved sufficiently toward the bottom (as seen in FIG. 11) to allow easy replacement and other maintenance of the first nozzle 77, the second nozzle 82, and the spacer 89.

Because a layer of compressed air from the second passage 86 is formed around the circumference of the pressurized water from nozzle port 81, the compressed air and pressurized water flow smoothly through spray passage 59 and are guided smoothly to the linear passage 57, where they form a high-speed ascending current. Thus it becomes possible to efficiently suck up and recover pieces of metal ore and other minerals from the sea bottom. In order to make it possible to supply current from the spray passages 59 to the inside of the main body 54 of the jet pump with as little disturbance as possible, the pipe passage 95 at the top of the main body 54 of the jet pump is somewhat extended in length.

As will be apparent from the foregoing, apparatus according to this invention makes possible the efficient recovery of pieces of metal ore and other minerals from the sea bottom. It is possible to regulate the jet pumps and other components with the most appropriate timing, while using a flow meter and a densimeter to continuously check the transport of the pieces of metal ore over the long distance of the lift pipe. Because the hydraulic feed pumps are located adjacent to the jet pumps, the pressurized water is supplied to the jet pumps at the pressure equal to the combination of the water head pressure at the depth of the corresponding jet pump and the drive pressure of the hydraulic feed pump, thus making it possible to use compact hydraulic feed pumps. The lift pipe has a linear passage, so that the pieces of metal ore and other minerals can be raised efficiently without becoming stuck. In addition, disassembly is easily accomplished, thus facilitating maintenance. By shortening the intervals at which the jet pumps are located along the lift pipe, the power needed for drawing up pieces of metal ore and other minerals can be adjusted to the desired level, and mining apparatus with the desired level of performance can be achieved.

Concerning the jet pumps located at intervals along the lift pipe, for the pumps higher up on the lift pipe, the flow of compressed air can be reduced and the intake of pressurized water increased, and for the pumps lower down, the flow of compressed air can be increased and the flow of pressurized water decreased, thus making it possible to adjust for the most efficient mining performance. At the start of operation, it is preferable that the flow of compressed air to the jet pumps higher up on the lift pipe be increased in order to enhance the air lift effect. Thus the operating conditions can be adjusted as appropriate. With use of the present jet pump, there is no reverse current generated even when high jet pressures are used. Moreover, in comparison to the conventional jet pump described herein, the speed of the jets and the drop in kinetic energy have been greatly improved, and the suction and transport performance of the jet pump has been greatly increased.

What is claimed is:

1. A jet pump comprising a main body having a linear passage through its center, a plurality of independent spray passages formed in said body and arranged around the circumference of said linear pasage and slanting inwardly toward and connecting with said linear passage, each of said spray passages being provided with an interior nozzle for spraying pressurized water, and an exterior nozzle outside of said first nozzle for spraying compressed air, said exterior nozzle extending around substantially the entire outer periphery of said interior nozzle.

2. A jet pump according to claim 1, and further including a casing detachably mounted on said main body and forming a common pressure chamber connected to said interior nozzles.

* * * * *